US009168652B2

(12) United States Patent
Schadow et al.

(10) Patent No.: US 9,168,652 B2
(45) Date of Patent: Oct. 27, 2015

(54) HAND-HELD POWER TOOL, IN PARTICULAR ELECTRIC HAND-HELD POWER TOOL

(75) Inventors: Joachim Schadow, Stuttgart (DE); Joerg Maute, Sindelfingen (DE); Manfred Lutz, Filderstadt (DE)

(73) Assignee: Robert Bosch GmbH, Stuttgart (DE)

( * ) Notice: Subject to any disclaimer, the term of this patent is extended or adjusted under 35 U.S.C. 154(b) by 928 days.

(21) Appl. No.: 13/319,521

(22) PCT Filed: Apr. 15, 2010

(86) PCT No.: PCT/EP2010/054921

§ 371 (c)(1), (2), (4) Date: Jan. 23, 2012

(87) PCT Pub. No.: WO2010/130519

PCT Pub. Date: Nov. 18, 2010

(65) Prior Publication Data

US 2012/0111595 A1 May 10, 2012

(30) Foreign Application Priority Data

May 11, 2009 (DE) ..... 10 2009 002 970

(51) Int. Cl.
*B25F 5/02* (2006.01)
*B25F 5/00* (2006.01)

(52) U.S. Cl.
CPC ..... *B25F 5/006* (2013.01)

(58) Field of Classification Search
CPC ..... B25F 5/006; B25F 5/02; B25D 17/043; B25D 17/24; B25D 2217/0092; B25D 17/04
USPC ..... 173/162.1, 162.2, 170
See application file for complete search history.

(56) References Cited

U.S. PATENT DOCUMENTS

| | | | | | |
|---|---|---|---|---|---|
| 5,052,500 | A | * | 10/1991 | Ohtsu | 173/162.2 |
| 5,692,574 | A | * | 12/1997 | Terada | 173/162.2 |
| H001811 | H | * | 11/1999 | Rescigno | 173/162.2 |
| 2005/0085124 | A1 | | 4/2005 | Kristen et al. | |
| 2006/0086515 | A1 | * | 4/2006 | Engelfried | 173/162.2 |

FOREIGN PATENT DOCUMENTS

| | | | |
|---|---|---|---|
| CN | 1822925 | A | 8/2006 |
| CN | 101088709 | A | 12/2007 |
| CN | 101088712 | A | 12/2007 |
| DE | 103 32 522 | A1 | 2/2005 |
| DE | 10 2005 016 453 | | 10/2006 |
| EP | 1 533 084 | | 5/2005 |

OTHER PUBLICATIONS

International Search Report corresponding to PCT Application No. PCT/EP2010/054921, mailed Aug. 3, 2010 (German and English language document) (6 pages).

* cited by examiner

*Primary Examiner* — Michelle Lopez
(74) *Attorney, Agent, or Firm* — Maginot, Moore & Beck LLP

(57) ABSTRACT

A hand-held power tool has a housing including at least two separate and interconnected housing parts, wherein one housing part forms a handle housing for holding and guiding the hand-held power tool. The handle housing includes a handle and a fastening component. The fastening component is connected to the other housing part and to the handle, and a vibration reduction element is arranged between the fastening component and the handle.

22 Claims, 5 Drawing Sheets

HAND-HELD POWER TOOL, IN PARTICULAR ELECTRIC HAND-HELD POWER TOOL

This application is a 35 U.S.C. §371 National Stage Application of PCT/EP2010/054921, filed on Apr. 15, 2010, which claims the benefit of priority to Application Serial No. DE 10 2009 002 970.2, filed on May 11, 2009 in Germany, the disclosures of which are incorporated herein by reference in their entirety.

BACKGROUND

The disclosure relates to a hand-held power tool, in particular an electric hand-held power tool.

DE 10 2005 016 453 A1 describes an angle grinder whose motor housing is connected to a rear housing cover, routed through the base of which there is a cable bush for supplying power to the electric drive motor. The housing cover is cup-shaped, wherein a full-perimeter sealing ring is inserted between the mutually facing end faces of the motor housing and housing cover, which sealing ring is effective in damping vibrations, in the axial direction and radial direction, that are emitted by the electric motor and that might be produced as work is performed on a workpiece.

SUMMARY

Proceeding from this prior art, the disclosure is based on the object of reducing, in a hand-held power tool, the perceptible vibrations that propagate from a drive unit, or are produced as work is performed on a workpiece, and that are transmitted into the housing of the hand-held power tool.

This object is achieved, according to the disclosure, by the features set forth below. Expedient developments are also set forth below.

According to the disclosure, a housing of a hand-held power tool is provided with at least two separate housing parts that are to be connected to one another, wherein one housing part constitutes a handle housing for holding and guiding the hand-held power tool. A vibration reduction element is disposed between the housing parts. It is furthermore provided that the handle housing consists of at least two separately realized handle housing parts, realized as a handle and as a fastening component, wherein the fastening component is connected, on the one hand, to the further housing part and, on the other hand, to the handle. A vibration reduction element is disposed between the fastening component and the handle.

This embodiment has the advantage that the handle can be decoupled, at least to a large extent, from oscillations and vibrations that are emitted by the drive unit, or that are produced as work is performed on a workpiece. The handle is connected in at least one spatial dimension to the further housing part—which is usually the motor housing—via the fastening component. For the purpose of vibration decoupling, the vibration reduction element is disposed between the fastening component and the handle, preferably being so disposed in the axial direction in which the fastening component secures the handle. The vibration reduction element is located in the transmission chain from the further housing component, via the fastening element, to the handle, such that the transmission of vibrations from the fastening component to the handle is at least reduced.

At the same time, this embodiment offers the possibility of configuring the direct contact between the handle and the further housing part in such a way that vibrations are also not transmitted, or are transmitted only in a reduced manner, via this path.

It is possible to dispense with fastening means that connect the handle to the further housing part. If necessary, such fastening means are nevertheless a possibility for fastening the handle to the further housing components.

According to a preferred embodiment, provided between the handle and the further housing component there is a further vibration reduction element, which has a supporting action, since the handle is supported on the further housing part via this additional vibration reduction element. Despite the support, vibrations propagating in the further housing part are transmitted to the handle only in a reduced manner.

Taken together, these measures provide for a significantly reduced handle vibration load, thereby improving operator comfort and reducing work stress. The division of the handle housing into a handle, on the one hand, and a fastening component, on the other hand, enables additional creative, or design, freedoms to be achieved, and allows vibration reduction elements to be disposed in a multiplicity of ways between the fastening component and the further housing part and/or between the fastening component and the handle, as well as, if necessary, between the handle and the further housing part.

The further housing part is preferably a motor housing, in which a drive unit, in particular an electric drive motor for driving the tool of the hand-held power tool, is accommodated. If necessary, further components are accommodated in the motor housing, for example electronic components, switches, etc. The handle housing constitutes, for example, a housing cover and, according to the disclosure, is realized in two parts, consisting of the handle and the fastening component, wherein the fastening component is directly connected to the motor housing, such that forces can be transmitted between the fastening component and the motor housing. In addition, the fastening component secures the handle in the correct position in respect of the motor housing.

According to a further advantageous embodiment, the handle constitutes a handle sleeve enclosing the further housing part, wherein, in this embodiment, the fastening component expediently constitutes the base, or a part of the base, such that, in the assembled state, the handle and the fastening component are together realized in a cup shape. The handle sleeve encloses the further housing part, and can be grasped in an ergonomically favorable manner by the operator for the purpose of holding and guiding the hand-held power tool. The fastening component, as the base of the cup-shaped housing cover that constitutes the handle, is positioned on the axial end face of the motor housing and, expediently, is connected to the end face of the motor housing. Possibilities for this are non-positive, materially bonded and/or positive measures, for example screwing the fastening component onto the end face of the motor housing. If necessary, the fastening component can also be adhesive-bonded.

According to an advantageous, easily realized embodiment, there is a vibration reduction element only between the fastening component and the handle, but not between the fastening component and the motor housing. The vibrations transmitted from the motor housing to the fastening component can propagate to the handle only in a reduced manner.

It can be expedient, however, to provide an additional vibration reduction element between the motor housing and the fastening component, such that, in total, at least two vibration reduction elements are disposed in the transmission chain from the motor housing to the fastening component and then on to the handle. As a result, vibration reduction in the handle is improved.

The vibration reduction element disposed between the fastening component and the handle acts in the axial direction and/or in the radial direction and, in this direction, damps, or reduces, the vibrations to which the fastening component is subjected. A vibration reduction element possibly provided between the further housing part and the fastening component also acts in the axial and/or radial direction.

According to an advantageous embodiment, it is provided that the vibration reduction element is disposed in the axial direction between an end edge of the fastening component and the handle, and, accordingly, acts in the axial direction. A further vibration reduction element can be disposed axially between an opposite end edge of the handle and a shoulder of the motor housing, such that the handle is delimited axially on opposite sides by a respective vibration reduction element. This results in a reduction of the transmission of vibrations both from the fastening component to the handle and from the motor housing to the handle.

For the vibration reduction element, various embodiments are possible. The vibration reduction element can be realized as a damping element that dissipates energy contained in the vibrations, such that vibrations are transmitted to the handle only in a reduced manner. Vibration-reducing materials, such as elastomers, rubber or rubber-like materials, foams, gels or the like, are preferably used for this purpose. Preferably, material-damping components are used, wherein, in principle, it is also possible to use motion-damping structural elements.

According to a further embodiment, it is provided that at least one vibration reduction element is realized as a spring element. Owing to the spring action of the vibration reduction element, vibrations and oscillations emitted by a component are transferred to the adjoining component in a reduced, or altered, form in respect of their frequency and amplitude, as a result of which it is also possible to achieve an effective reduction in the vibration load in the handle, in particular a shift from critical to non-critical frequencies. For the spring element, it is possible to use separately realized spring elements, for example coil springs or leaf springs, which are disposed between the fastening component and the handle, or located between the motor housing and the fastening component, or between the handle and the motor housing. Alternatively, in a further embodiment, the spring elements can also be realized so as to be integral with a housing part, for example as a resilient projection that is elevated above the surface of a housing part and is in contact with a further housing part.

Also possible as vibration reduction elements, if necessary, is a combination of spring elements and damping elements.

According to a further advantageous embodiment, the handle housing is realized as a double wall, or double shell, in that the fastening component constitutes an inner handle sleeve that is directly connected to the motor housing, and the handle constitutes the outer handle sleeve, which is located at a radial distance from the inner fastening component, such that an annular space is constituted, as an interspace, between a sleeve-type, inner fastening component and a sleeve-type, outer handle. For the purpose of at least damping a transmission of vibrations from the motor housing, via the inner fastening component, to the outer handle, at least one vibration reduction element is preferably disposed in the annular interspace. The inner fastening component, on the other hand, can be fixedly connected to the motor housing, wherein vibrations transmitted to the fastening component do not result in increased vibration load for the operator, owing to the decoupling of the handle. The interspace can be used, advantageously, to accommodate the vibration reduction elements, such that no additional structural space is required for housing vibration reduction elements.

Vibration reduction elements of various types can be disposed in the interspace. Possibilities include both damping elements, in particular elements having material-damping properties, thus also spring elements that alter the amplitude and the frequency of the transmitted vibrations. A further possibility is a combined application of damping and spring elements.

In a further embodiment, the vibration reduction element is realized as a gas pressure spring, wherein a volume of gas is enclosed by sealing elements disposed in the interspace between the fastening component and the handle.

The vibration reduction elements in the annular interspace effect vibration damping both in the radial direction and in the axial direction. In order to increase the vibration damping in the axial direction, it can be expedient to align at least one vibration reduction element with an additional axial component in the interspace, for example in such a way that a coil spring is positioned obliquely in the interspace, such that the spring axis encloses an angle both with the radial direction and with the axial direction.

Expediently, a plurality of vibration reduction elements, distributed over the axial length, are disposed in the annular interspace, in order to ensure that the outer handle is supported on the inner fastening component in a uniform manner over the axial length.

Preferably, the supporting of the outer handle is effected exclusively via vibration reduction elements, in order to prevent vibration transmission bridges.

Furthermore, it can be expedient for the outer handle to be positively secured to the inner fastening component. This is realized, for example, in that formed on the handle there is a radially inwardly projecting latching projection, assigned to which there is a radially outwardly facing latching projection on the outside of the fastening component. The radial latching projections are slightly offset axially in relation to one another, they can directly adjoin one another axially, so as to reliably prevent the handle from being inadvertently detached axially from the hand-held power tool. To enable the handle to be pushed on or drawn off for servicing purposes, however, a bayonet catch, for example, is a possibility.

According to a further aspect of the disclosure, the hand-held power tool has at least two separate housing parts that are to be connected to one another, wherein one housing part constitutes a handle part for holding and guiding the hand-held power tool, and wherein a damping element is disposed between the housing parts. The damping element is realized so as to be integral with a cable bush, which encloses an electric power cable routed into the housing for supplying power to an electric drive motor of the hand-held power tool.

In this embodiment, the cable bush, which is usually composed of a material-damping material such as, for example, elastomer, is used at the same time for vibration damping, or vibration reduction, providing for a simplified design and a reduction in the number of components. Since the electric power cable for supplying power is usually taken into the housing via the rear end face, the damping element is also located at the rear end face of the motor housing, and can be connected to the handle in the manner of a fastening component, such that the handle is secured, in at least one axial direction relative to the motor housing, via the damping element and the cable bush that is realized so as to be integral with the damping element.

BRIEF DESCRIPTION OF THE DRAWINGS

Further advantages and expedient embodiments are given by the further claims, the description of the figures and by the drawings, wherein:

DETAILED DESCRIPTION

In the figures, components that are the same are denoted by the same references.

Figure 1:
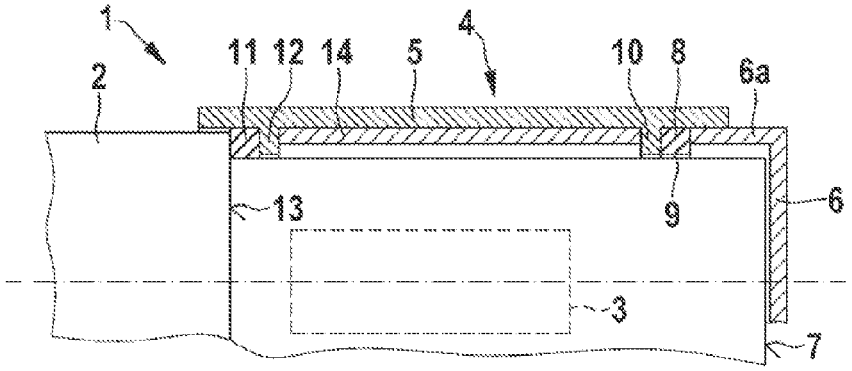
FIG. 1 shows a hand-held power tool having a multi-part housing, which comprises a motor housing, as a first housing part, and comprises a two-part handle housing, as a further housing part, wherein the handle housing consists of a sleeve-type handle and an end-face fastening component that is connected to the end face of the motor housing, wherein a damping element is disposed between the fastening component and the handle.

The electric hand-held power tool represented in FIG. 1, for example an angle grinder or an electric drill or screwdriver, has a housing, consisting of a motor housing 2, disposed in which there is an electric drive motor 3, and of a handle housing 4, which is connected to the motor housing 2. The handle housing 4 is constructed in two parts, and consists of a handle 5 and a fastening component 6. The handle 5 is realized as a handle sleeve, which is pushed onto the rear portion of the motor housing 2 and encloses the latter in the manner of a ring. The fastening component 6 is located at the rear axial end face 7 of the motor housing 2. The sleeve-type handle 5 and the fastening component 6 together constitute a handle cup, which is pushed onto the motor housing 2. The fastening component 6 in this case is realized in the form of a disk, and has a wall portion **6*a* that projects axially and extends in the direction of the handle 5. The fastening component 6 is fixedly connected to the rear end face 7 of the motor housing 2, the fastening component 6 bearing, in particular, directly against the end face 7**.

The axially projecting portion **6*a* of the fastening component 6 supports the handle 5, and exerts an axial supporting force upon the latter. The free end face of the wall portion 6*a* of the fastening component 6 is not in direct contact with the handle 5, however, but between the handle 5 and the fastening component 6 there is a damping element 8, which has the function of damping vibrations that propagate out from the motor housing 2 via the fastening component 6. The damping element 8 is realized, for example, as a damping ring, which extends along the outer circumferential surface of the motor housing 2. Also possible, however, is an embodiment in which the damping element is realized, not in the form of a ring, but only as a segment, wherein, in this variant, preferably a plurality of individual damping elements are provided, distributed over the circumference, between the fastening component 6 and the handle 5**.

Particularly in the embodiment as a ring, the damping element 8 is seated in a contoured seating 9 that extends in the manner of a ring round the full perimeter and that is formed on the outer circumferential surface of the motor housing 2.

The damping element 8 is located between the end face of the axial wall portion **6*a* of the fastening component and a radially inwardly extending continuation 10 realized integrally on the handle 5. The damping element 8** transmits supporting forces in the axial direction, and also exerts its damping action in the axial direction. Various materials are possible as a material for the damping element, e.g. elastomers, rubber or gels or the like.

Located on the handle 5, on the side axially opposite the first damping element 8, there is a further damping element 11, which is clamped axially between a radially inwardly projecting continuation 12 on the handle 5 and a shoulder 13 on the motor housing 2, and which both transmits supporting forces in the axial direction and exerts its damping action in the axial direction. The shoulder 13 on the motor housing 2 is realized, in particular, as a full-perimeter annular shoulder. The damping element 11, like the damping element 8, is preferably realized as a damping ring.

Expediently, as viewed in the radial direction, the extent of the damping elements 8 and 11 is greater than the extent of the inwardly projecting continuations 10 and 12, such that the free end faces of the continuations 10 and 12 are not in contact with the outer circumferential surface of the motor housing 2, and direct contact between the handle 5 and the motor housing 2 is prevented. It is thereby ensured that there is no direct transmission of vibrations from the motor housing 2 to the handle 5. The radial distance in this case is determined, on the one hand, by the radial extent of the damping elements 8 and 11, and also, on the other hand, by the radial extent of the seating 9, which is disposed on the outside of the motor housing 2 and serves to accommodate the damping element.

The connection between the fastening component 6 and the end face 7 on the motor housing 2 is effected by means of ordinary fastening measures, for example by screw connection. It can be expedient, if necessary, for a further vibration reduction element to be disposed between the end face 7 and the fastening component 6.

In the exemplary embodiment according to FIG. 1, the vibration reduction elements are realized as damping elements 8 and 11. In principle, however, instead of the damping element it is also possible to use spring elements, which, likewise, can exert a vibration-reducing action, but at least a frequency shift towards non-critical frequencies.

An absorption element 14 can be located in the annular space between the outer circumferential surface of the motor housing 2 and the inside of the handle 5, which, owing to the continuations 10 and 12 that project radially inward and the damping elements 8 and 11, is at a distance from the circumferential surface. The absorption element 14 is, in particular, fixedly connected to the handle 5, and serves to increase the moment of inertia of the handle 5, whereby both the frequency and the amplitude of the vibrations acting upon the handle 5 are altered. In this way, through the selection of an appropriate absorption element 14, the vibration load acting upon the handle can be reduced.

The absorption mass 14 is preferably connected to the handle 5 in a fixed and immovable manner. According to an alternative embodiment, however, it can also be expedient for the absorption mass 14 to be connected to the handle 5, but to be able to execute a relative movement in relation to the handle 5. In this way, a vibrational two-mass system having an intermediate spring element is achieved, whereby, likewise, both the frequency and the amplitude of the vibrations of the handle 5 are altered.

Figure 2:
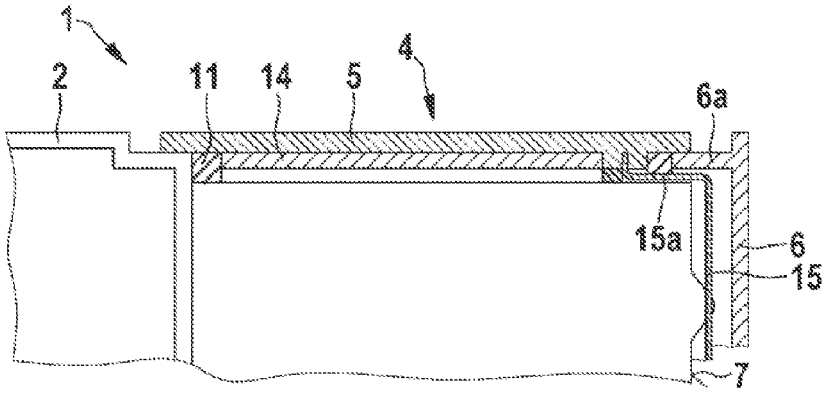
FIG. 2 shows a further exemplary embodiment of the hand-held power tool, in which the handle is connected to the motor housing via a leaf spring.

In the exemplary embodiment according to FIG. 2, the sleeve-type handle 5 is connected to the axially rear end face 7 of the motor housing 2 by means of a spring element 15. The spring element 15 is realized as a leaf spring, which is angled in form and extends with one portion on the end face 7 of the engine housing 2 and with an angularly offset portion in the axial direction. The angularly offset portion 15*a* has, in the region of its free end face, a radially outwardly directed protrusion that projects into a groove on the inside of the handle 5, such that a positive connection is effected in the axial direction between the portion 15*a* of the spring element 15 and the handle 5. Generally, however, it is also possible to use other connection measures between the spring element 15 and the handle 5, in order to secure the handle 5 in the axial direction or, owing to the spring action, to achieve a reduction in vibrations in the axial direction and also, if necessary, in the radial direction. In this exemplary embodiment, the fastening component 6 has the function of covering the end face 7. The portion 6*a* of the fastening component 6 that extends in the axial direction is connected, expediently, to the handle 5, wherein, as viewed in the axial direction, a damping element can be disposed between the free end face of the portion 6*a* and a continuation projecting radially inward on the inside of the handle 5.

Figure 3:
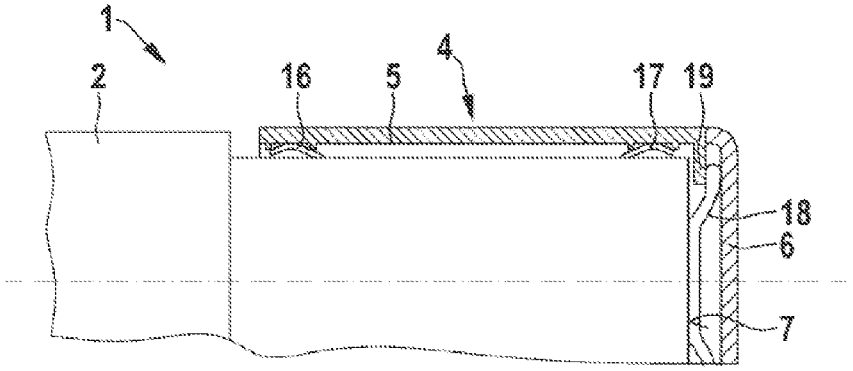
FIG. 3 shows a further exemplary embodiment, in which spring elements, for securing the handle and the fastening cover, are realized so as to be integral with the motor housing.

In the exemplary embodiment according to FIG. 3, spring elements 16, 17 and 18 are formed respectively both on the outer circumferential surface of the motor housing and on the rear, axial end face 7. These spring elements 16, 17 and 18 are realized so as to be integral with the motor housing, and are elevated in a finger-like manner above the circumferential surface and the rear end face of the motor housing. The two spring elements 16 and 17 on the outer circumferential surface of the motor housing 2 act upon the inside of the sleeve-type handle 5, and thereby transmit a clamping force in the radial direction. In addition, the spring elements 16 and 17 can act in conjunction with a shaped seating on the inside of the handle 5, whereby a positive locking is achieved in the axial direction, such that forces can also be transferred in the axial direction. The free end faces of the finger-like spring elements 16 and 17 extend in opposing directions, the rear spring element 17 being directed towards the rear end face 7.

Formed on the rear end face 7 is a further spring element 18, which acts axially upon the fastening element 6. The free end faces of the spring element 18 extend in the radial direction and, when in the assembled position, lie in a latching recess that is delimited, on the one hand, by the inside of the cover-type fastening element 6 and, on the other hand, by a radially inwardly projecting continuation 19.

The spring elements 16 and 17 on the circumferential surface of the motor housing 2 can extend in the manner of a ring in the circumferential direction on the outside of the motor housing. Also possible, however, is an embodiment as single, segmented spring elements.

Figure 4:
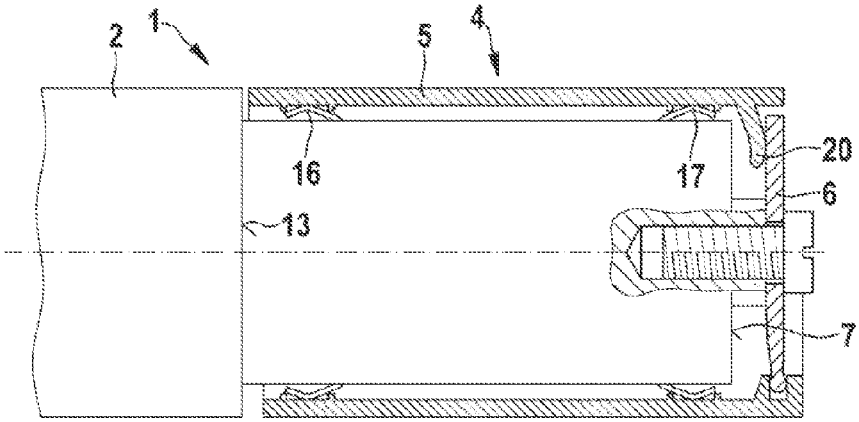
FIG. 4 shows a further exemplary embodiment, in which, formed on the outside of the motor housing, there are spring elements that act upon the handle, wherein, formed on the handle, there are further spring elements, bearing against which is the fastening component that is directly screw-connected to the motor housing.

In the exemplary embodiment according to FIG. 4, the fastening component 6 is realized as a base plate, which is screwed to the end face 7 of the motor housing 2 by means of a screw 21. Acting upon the fastening component 6 in the axial direction is a spring element 20, which extends radially inward on the inside of the sleeve-type handle 5 and is formed on the handle 5 so as to be integral therewith. The spring element 20 produces an axial force, which counteracts the pressing force achieved through the fastening component 6, by means of the screw 21. The axial force presses the handle 5 axially against the shoulder 13 on the motor housing 2, such that, through the fastening component 6, the handle 5 is secured axially in both directions.

In addition, the radially elevated spring elements 16 and 17 that are formed on the outer circumferential surface of the motor housing 2 so as to be integral therewith act upon the handle 5 in the radial direction.

Expediently, the spring element 20 formed on the inside of the handle 5 is not realized in the form of a ring, but extends only over a limited angular portion. Realized on the inside of the handle 5, on the side that is diametrically opposite the spring element 20, there is a groove, into which there projects the edge region of the plate-type fastening component 6.

Figure 5:
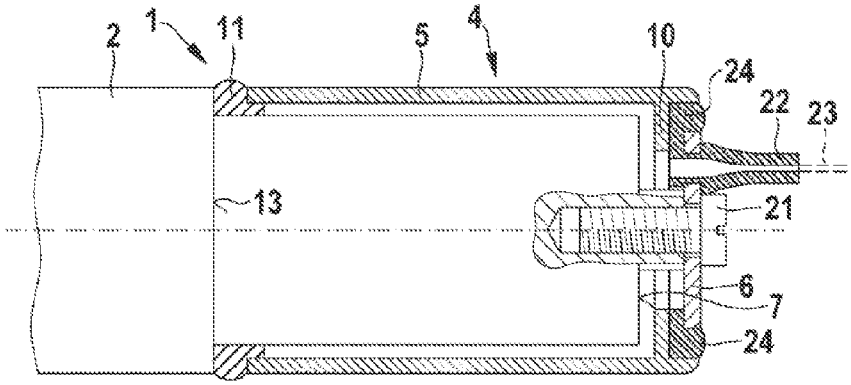
FIG. 5 shows a further exemplary embodiment, in which a cable bush, which encloses an electric power cable, is realized so as to be integral with a damping element.

In the exemplary embodiment according to FIG. 5, an electric power cable 23 is disposed at the rear axial end face 7 of the motor housing 2, which power cable, into the interior of the motor housing, serves to supply power to the electric drive motor located there. The electric power cable 23 is enclosed by a cable bush 22, which is composed of an elastic material having vibration-damping properties. Realized so as to be integral with the cable bush 22 is a damping element 24, which is in the form of a disk, or ring, and whose radial outside is in contact with the inner wall of the handle 5 in the region of the free end face of the handle. In addition, formed on the inside of the handle 5 there is a continuation 10, the damping element 24 acting axially upon the latter.

The cover-type, or plate-type, fastening component 6, which is screwed to the end face of the motor housing 2 by means of a screw 21, is inserted in the recess made in the annular damping element 24. The fastening component 6 acts upon the damping element 24 in the axial direction and presses the latter, in the direction of the end face 7 of the motor housing, against the continuation 10 on the inside of the handle 5.

On the side that is opposite the cable bush 22, on the free end face of the handle 5, there is a further damping element 11, which is clamped-in between the end face of the handle 5 and the annular shoulder 13 on the motor housing 2.

Figure 6:
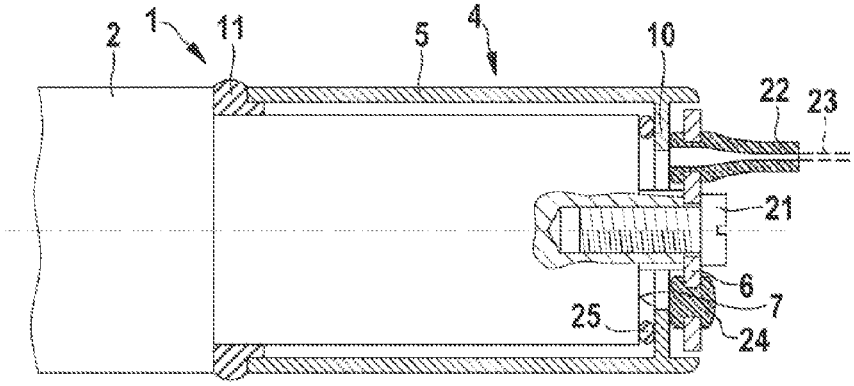
FIG. 6 shows a further exemplary embodiment, in which the cable bush and the damping element are realized as separate components.

In the exemplary embodiment according to FIG. 6, the cable bush 22, which encloses the electric power cable 23, and the damping element 24 are realized as separate components.

Both the cable bush 22 and the damping element 24, which are each disposed on the end face 7, are clamped axially by the plate-type fastening component 6, which is screwed onto the end face 7 of the motor housing 2 by means of the screw 21. The cable bush 22 and the damping element 24 are pressed axially against the radially inwardly projecting continuation 10 formed on the inside of the handle 5 by the pressure of the fastening element 6.

On the side that faces away from the damping element 24, between the continuation 10, which extends in the form of a ring on the inside of the handle 5, and the end face 7 of the motor housing 2, there is a further damping element 25, which is realized in the form of a ring.

In the exemplary embodiments according to FIGS. 7 to 15, the handle housing 4 is likewise in two parts, but the fastening component 6 constitutes an inner, cup-shaped handle sleeve, which lies directly on the motor housing 2, or is connected to the latter. The handle 5 constitutes an outer handle sleeve, which has a greater diameter than the fastening component 6, and which is pushed onto the fastening component 6. An annular interspace 26, which serves to accommodate vibration reduction elements, is formed between the outer circumferential surface of the fastening component 6 and the inner circumferential surface of the handle 5.

Figure 7:
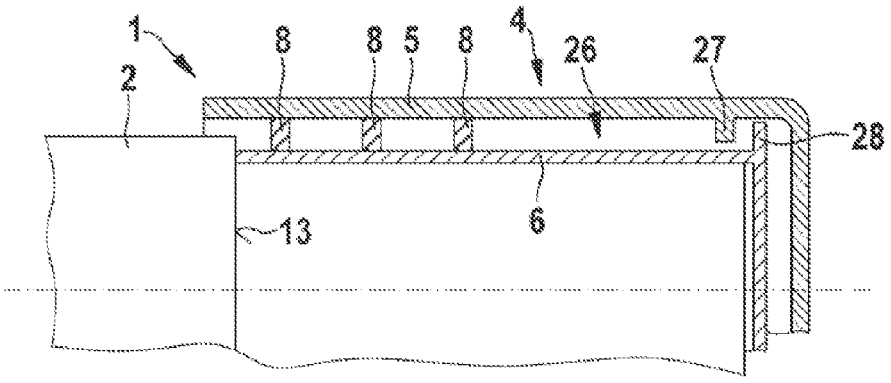
FIG. 7 shows a further exemplary embodiment, in which the handle housing is designed as a double shell, wherein the fastening component constitutes an inner handle sleeve and the handle constitutes an outer handle sleeve at a distance therefrom, and wherein damping elements are disposed between the inner fastening component and the outer handle.

As can be seen from FIG. 7, damping elements 8 are disposed, as vibration reduction elements, in the interspace 26, wherein the damping elements 8 are each composed of a material having vibration-damping properties. A plurality of such damping elements 8 are distributed over the axial length. The damping elements 8 can either be realized in the form of a ring and extend over the circumference of the interspace 26 or, according to an alternative embodiment, they can be realized in the form of a segment.

The vibration reduction elements 8 in the interspace 26 of FIGS. 7 to 15 assume, on the one hand, a vibration-damping function, in order to relieve the outer handle 5 of vibrations that are emitted from the motor housing 2 and propagate into the fastening component 6. On the other hand, the vibration reduction elements also assume a support function, in order to fix the sleeve-type handle 5 in the correct seating position in the radial direction and also, if necessary, in the axial direction.

As can further be seen from FIG. 7, for the purpose of securing the handle 5 axially on the hand-held power tool 1, latching projections 27 and 28, each extending in the radial direction, are formed, respectively, on the inside of the handle 5 and on the outside of the fastening component 6, wherein the dimensions of the latching projections 27 and 28 in the radial direction are selected such that a positive locking ensues in the axial direction. In this case, the latching projection 27 formed on the inside of the handle 5 is at a greater axial distance from the end face of the hand-held power tool than the second latching projection 28, which is formed on the fastening component 6, such that the handle 5 cannot become detached axially.

On the side that is opposite the rear, axial end face of the motor housing 2, the free end face of the fastening component 6 bears against the shoulder 13 formed on the motor housing 2.

Figure 8:
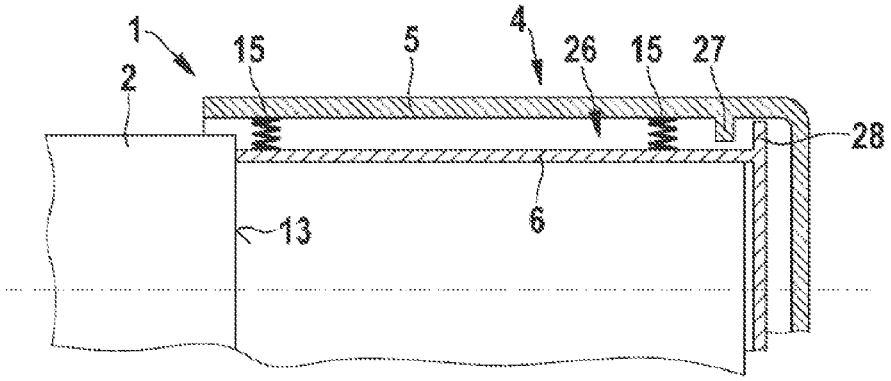
FIG. 8 shows an exemplary embodiment having the handle housing likewise of a double-walled embodiment, wherein spring elements are disposed between the inner and the outer handle sleeve.

In the exemplary embodiment according to FIG. 8, the vibration reduction elements, which are disposed in the interspace 26 between the fastening component 6 and the handle 5, each consist of a spring element, for example a coil spring, which is loaded in compression. According to FIG. 8, the spring axis extends in the radial direction. Owing to the spring action in the radial direction, corresponding vibrations are altered according to their frequency and amplitude such that, overall, the vibration load in the handle 5 is reduced. Moreover, the spring elements 15 also cause the handle 5 to be stabilized in the axial direction.

A plurality of such spring elements 15, distributed over the axial length, are disposed in the interspace 26.

Figure 9:
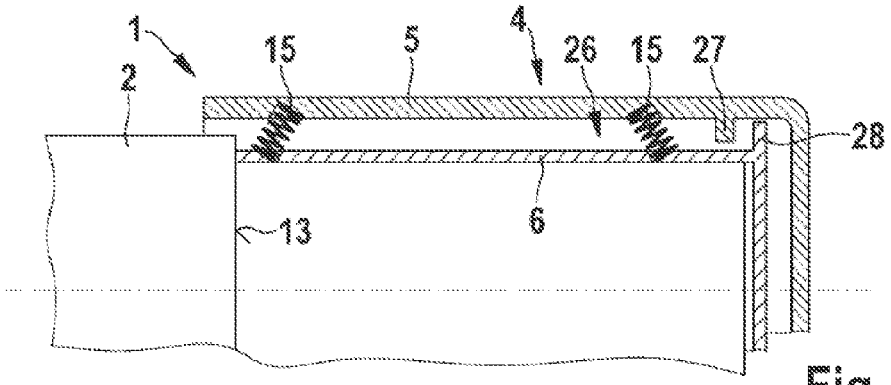
FIG. 9 shows an exemplary embodiment similar to FIG. 8, but having obliquely set spring elements in the interspace between the inner and the outer handle sleeve.

The exemplary embodiment according to FIG. 9 differs from the preceding exemplary embodiment in that the spring elements 15 are inclined at an angle in the interspace 26, such that the spring longitudinal axis assumes an angle in each case, both in relation to the axial direction of the housing and in relation to the radial direction. A plurality of such spring elements 15 are provided, distributed over the axial length, if necessary also distributed over the circumference, wherein axially spaced-apart spring elements 15 are inclined at an angle in such a manner that the radially inner end face of the spring elements 15, which in each case is coupled to the fastening element 6, is directed towards the respective axial end face of the fastening component.

Figure 10:
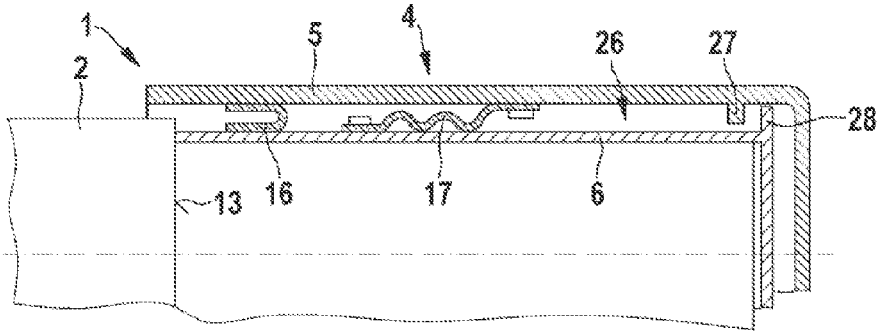
FIG. 10 shows a further exemplary embodiment having a double-walled handle housing, having various spring elements, realized as leaf springs, in the interspace between the handle sleeves.

In the exemplary embodiment according to FIG. 10, the vibration reduction elements in the interspace 26 between the fastening component 6 and the handle 5 are each realized as leaf springs, of differing geometric configuration. A first spring element 16 is realized as a U-shaped leaf spring, a second spring element 17 has a waved form. The U-shaped spring element 16 is merely clamped in the interspace 26, wherein, in this case, it is possible to dispense with additional fastening measures for fixed connection to the outside of the fastening component 6 and to the inner wall of the handle 5; nevertheless, it can be expedient to provide such fastening elements.

The second, waved spring element 17 is connected to the wall of the fastening component 6 and to the wall of the handle 5 via a respective fastening element.

Figure 11:
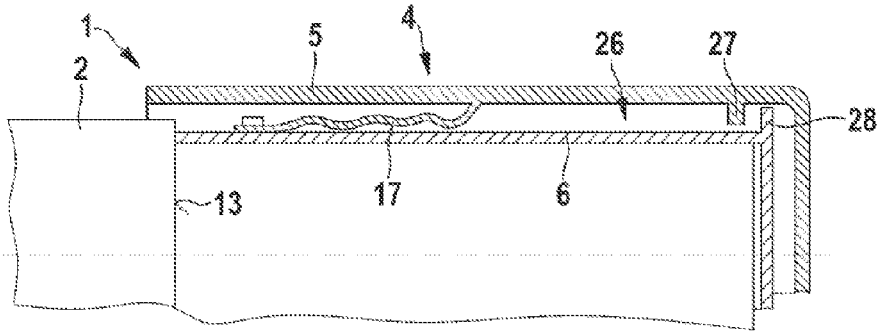
FIG. 11 shows an exemplary embodiment in which, disposed in the interspace, there is a leaf spring realized so as to be integral with the wall of the outer handle.

In the exemplary embodiment according to FIG. 11, the vibration reduction element is likewise realized as a spring element disposed in the interspace 26. The figure shows a waved spring element 17, which is formed on the inner wall of the handle 5 and thus realized so as to be integral with the handle 5. On the fastening component 6 side, the spring element 17 is connected by a fastening means, for example by means of a screw.

Figure 12:
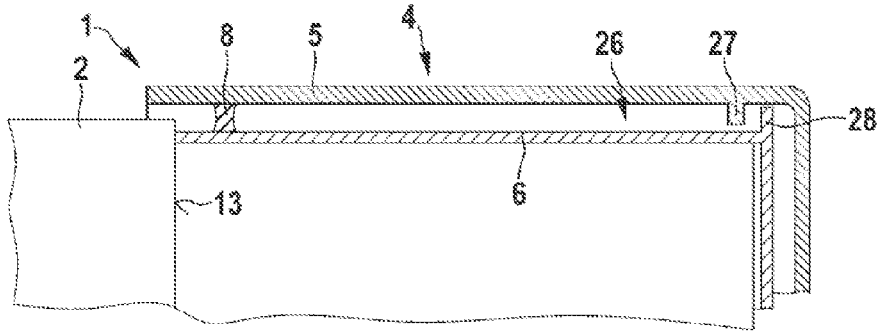
FIG. 12 shows an exemplary embodiment in which there is a volume of gas in the interspace.

In the exemplary embodiment according to FIG. 12, the interspace 26 is closed in a gas-tight manner, such that the volume of gas present in the interspace 26 acts in the manner of a gas spring. At the free end face of the fastening component 6 and of the handle 5, the gas-tight closure is achieved by means of an annular damping element 8 disposed adjacently to the shoulder 13 on the motor housing 2. The volume of gas stabilizes the handle 5 in the correct position in relation to the motor housing 2 and the fastening component 6, and also effects vibration damping.

Figure 13:
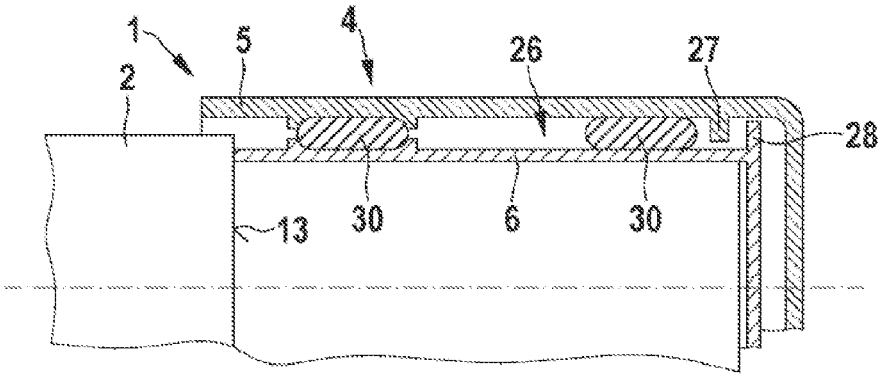
FIG. 13 shows an exemplary embodiment in which fluid-filled damping elements are disposed in the interspace.

In the exemplary embodiment according to FIG. 13, fluid cushions 30, which function as vibration reduction elements and additionally support the handle 5 radially and in the axial direction, are located in the interspace 26. The fluid cushions 30 can be filled with compressed gas, such that the fluid cushions become highly elastic. In principle, however, a liquid filling is also possible.

The fluid cushions 30 can be inserted in groove-type guide parts, which are formed on the outside of the fastening component 6 and on the inside of the handle 5 and which, in particular, positively fix the axial position of the fluid cushion 30.

Figure 14:
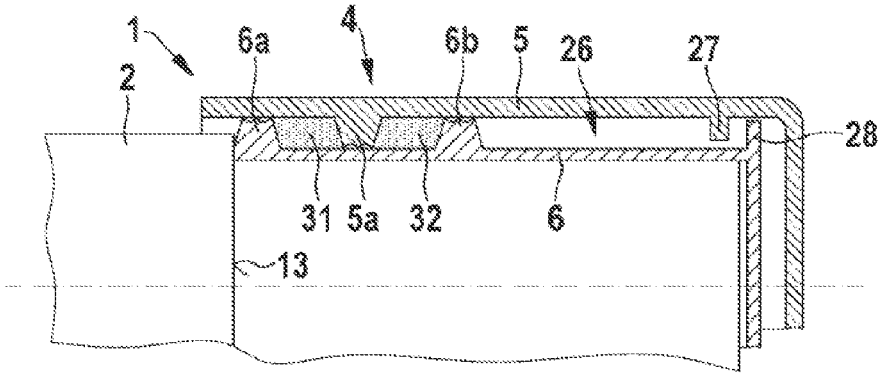
FIG. 14 shows an exemplary embodiment in which a volume of gas is enclosed in a pressure-tight manner in the interspace.

In the exemplary embodiment according to FIG. 14, in the interspace 26 there are two separately realized volumes of gas 31 and 32, which are sealed off, or separated, from one another, or axially outward, by sealing rings 6*a*, 6*b* and 5*a*. In the exemplary embodiment, the sealing rings 6*a*, 6*b* and 5*a* are realized so as to be integral with the fastening component 6 and the handle 5, respectively, and are each in the form of radially elevated rings. In principle, however, separately realized sealing rings are also possible.

The three rings 6*a*, 6*b* and 5*a* are spaced apart from one another axially, such that a first volume of gas 31 is enclosed between the ring 6*a* and the ring 5*a*, and a second volume of gas 32 is enclosed between the ring 5*a* and the ring 6*b*. As the handle 5 is displaced axially relative to the fastening component 6, the pressure in the compressed volume of gas is increased, or the pressure in the expanding volume of gas is reduced, as a result of which a corresponding axial restoring force is produced, the latter tending to reset the handle 5 from the elongated position to the initial position.

Figure 15:
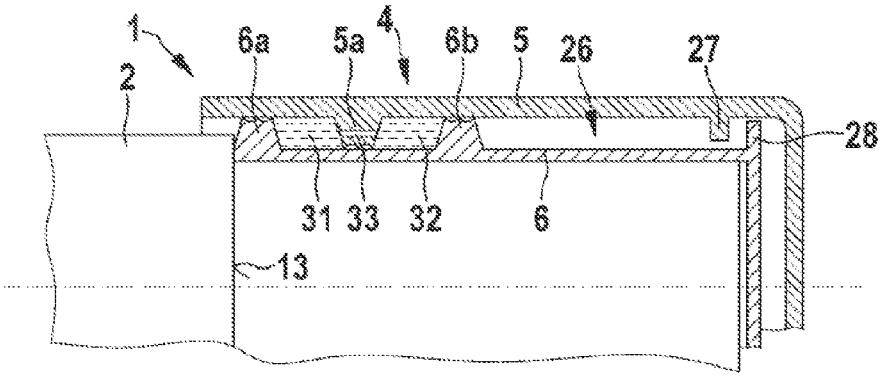
FIG. 15 shows an exemplary embodiment similar to FIG. 14, but with a connecting restrictor channel between two separate volumes of gas or fluid in the interspace.

The exemplary embodiment according to FIG. 15 corresponds substantially to that according to FIG. 14, but with the difference that a restrictor channel 33 connecting the two volumes of fluid 31 and 32 is routed through the sealing ring 5*a*. The restrictor channel 33 allows an exchange of the respective volumes of fluid, wherein the restricting action enables speed damping to be achieved in respect of the axial movement of the handle 5 relative to the fastening component 6.

If necessary, the volumes 31 and 32 in the exemplary embodiment according to FIGS. 14 and 15 are filled, not with gas, but with a liquid.

The invention claimed is:

1. A hand-held power tool, comprising:

a housing having at least two separate housing parts configured to be connected to one another, wherein a first housing part of the two housing parts constitutes a handle housing configured to be held, and a second housing part of the two housing parts constitutes a motor housing, and a vibration reduction element disposed between the handle housing and the motor housing, wherein the handle housing includes at least two separate handle housing parts including a first handle housing part configured as a handle and a second handle housing part configured as a fastening component, wherein the fastening component is connected to the motor housing and to the handle, wherein the vibration reduction element is disposed between the fastening component and the handle, and wherein the vibration reduction element is disposed radially between the handle and the motor housing.

2. The hand-held power tool according to claim 1, wherein the handle is configured as a handle sleeve enclosing the motor housing.

3. The hand-held power tool according to claim 1, wherein the vibration reduction element is disposed axially between the handle and the fastening component.

4. The hand-held power tool according to claim 1, wherein the vibration reduction element is disposed axially between the handle and the motor housing.

5. The hand-held power tool according to claim 1, wherein at least one vibration reduction element is configured as a damping element.

6. The hand-held power tool according to claim 1, wherein at least one vibration reduction element is configured as a spring element.

7. The hand-held power tool according to claim 6, wherein the spring element is configured so as to be integral with the motor housing, the handle, or the fastening component.

8. The hand-held power tool according to claim 1, wherein at least one vibration reduction element is configured as a gas pressure spring.

9. The hand-held power tool according to claim 8, wherein the gas pressure spring is constituted by a volume of gas enclosed between sealing elements in the interspace delimited by the handle and the fastening component.

10. The hand-held power tool according to claim 1, wherein the motor housing is configured to accommodate a drive motor.

11. The hand-held power tool according to claim 1, wherein the fastening component is a securing cover that bears axially at against an end face of the motor housing.

12. The hand-held power tool according to claim 1, wherein the handle housing is configured as a double shell, or double wall, wherein the fastening component constitutes an inner handle component, and the handle constitutes an outer handle component.

13. The hand-held power tool according to claim 12, wherein the vibration reduction element is disposed in an interspace between the inner fastening handle component and the outer handle component.

14. The hand-held power tool according to claim 13, further comprising a plurality of vibration reduction elements distributed over the axial length, and disposed in the interspace.

15. The hand-held power tool according to claim 12, wherein the handle is positively secured to the fastening component.

16. The hand-held power tool according to claim 15, wherein the handle is positively secured to the fastening component by radial latching projections on the outside of the fastening component and on the inside of the handle.

17. A hand-held power tool, comprising:

a housing having at least two separate housing parts configured to be connected to one another, wherein a first housing part of the two housing parts constitutes a handle housing configured to be held, and a second housing part of the two housing parts constitutes a motor housing, and a vibration reduction element disposed between the handle housing and the motor housing, wherein the handle housing includes at least two separate handle housing parts including a first handle housing part configured as a handle and a second handle housing part configured as a fastening component, wherein the fastening component is connected to the motor housing and to the handle, wherein the vibration reduction element is disposed between the fastening component and the handle, wherein the handle housing is configured as a double shell, or double wall, wherein the fastening component constitutes an inner handle component, and the handle constitutes an outer handle component, wherein the vibration reduction element is disposed in an interspace between the inner fastening handle component and the outer handle component, wherein the vibration reduction element is disposed exclusively in the interspace between the inner handle component and the outer handle component, and wherein the interspace is an annular interspace.

18. A hand-held power tool, comprising:

a housing having at least two separate housing parts configured to be connected to one another, wherein a first housing part of the two housing parts constitutes a handle housing configured to be held, and a second housing part of the two housing parts constitutes a motor housing, and a vibration reduction element disposed between the handle housing and the motor housing, wherein the handle housing includes at least two separate handle housing parts including a first handle housing part configured as a handle and a second handle housing part configured as a fastening component, wherein the fastening component is connected to the motor housing and to the handle, wherein the vibration reduction element is disposed between the fastening component and the handle, wherein the vibration reduction element includes a damping element, and wherein the damping element is configured so as to be integral with a cable bush of an electric power cable for supplying power to an electric drive motor.

19. The hand-held power tool according to claim 18, wherein the damping element bears with the cable bush against an end face of the motor housing part.

20. The hand-held power tool according to claim 18, wherein the damping element is configured in the form of a ring.

21. The hand-held power tool according to claim 18, wherein fastening to the motor housing is effected through the damping element.

22. The hand-held power tool according to claim 18, wherein the damping element is connected to the handle.

* * * * *